United States Patent [19]

Bottomley

[11] Patent Number: 4,674,218

[45] Date of Patent: Jun. 23, 1987

[54] INTERCHANGEABLE GUN CLEANING DEVICES

[76] Inventor: C. Edward Bottomley, 130 Griffin Rd., West Suffield, Conn. 06093

[21] Appl. No.: 887,445

[22] Filed: Jul. 21, 1986

[51] Int. Cl.[4] ..... F41C 31/00

[52] U.S. Cl. ..... 42/95; 403/165; 15/104.09; 15/140.05

[58] Field of Search ..... 42/95, 96; 403/299, 403/342, 368, 370, 164, 165; 15/104.01 R, 104.01 P, 104.02, 104.03, 104.05, 104.09, 104.1 R, 104.11, 104.16, 104.165

[56] References Cited

U.S. PATENT DOCUMENTS

| | | | |
|---|---|---|---|
| 470,254 | 3/1892 | Patterson | 15/104.165 |
| 1,537,203 | 8/1924 | Swan | 403/165 |
| 1,665,257 | 4/1928 | Dake | 42/95 |
| 3,208,302 | 9/1965 | Lewis et al. | 42/95 |

FOREIGN PATENT DOCUMENTS

| | | | |
|---|---|---|---|
| 17286 | 3/1904 | Sweden | 15/104.165 |
| 10999 | of 1892 | United Kingdom | 15/104.165 |

*Primary Examiner*—Deborah L. Kyle
*Assistant Examiner*—Michael J. Carone
*Attorney, Agent, or Firm*—Ross, Ross & Flavin

[57] ABSTRACT

A gun bore cleaning device serves rods of different diameters with a handle which accommodates to the different rods. The handle has a central through-bore which communicates with an enlarged threaded bore at each of its inboard and outboard ends. The rods are extendable through the central through bore. Each has an end cap fixed thereon at the outboard end thereof for seating in the enlarged bore at the outboard handle end. A threaded inboard end cap is sleevable upon the rod and is threadable into the inboard bore so as to be walked into tight interengagement with the handle. A threaded outboard end cap fits over the end cap and is threadable into the outboard bore so as to be walked into tight interengagement with the handle.

1 Claim, 8 Drawing Figures

INTERCHANGEABLE GUN CLEANING DEVICES

My invention relates to improvements in devices for wiping and cleaning the inner walls of gun barrels and more particularly in devices where the wiper component may be free to rotate as the tool is drawn back and forth within a barrel, the rotation being imparted to the wiper component by the barrel rifling.

One object of the invention is the provision of a device of this character in which the bore in the barrel of a gun, rifle, boiler tube or the like may be thoroughly cleaned of foreign matter and wiped out.

Another object is the provision of a device of this character in which the wiping head may be readily and easily removed when the same becomes dirty or worn, thereby permitting the application of a new one in its stead A further object of the invention is the provision of a device in which the wiper is free to rotate as it is advanced within the bore in the barrel of a gun, thereby removing foreign matter from the wall of said bore for the thorough cleaning of the same.

A still further object of the invention is the provision of a device of this character which is simple in construction, thoroughly reliable and efficient in operation and inexpensive in manufacture.

The packaging system teaches the feature of providing a plurality of cleaning rods with which a single novel handle may be interchangeable. Without the handle being permanently attached to any particular rod, the package offers the advantage that it will pack and/or store more easily, its single handle being adapted for quick and ready use with a variety of field rods which the gunman may bring, be it to the range or to the hunt or wherever he anticipates a need for his gun cleaning equipment.

Additionally provision is made in the package for a plurality of rifle rods adapted for use with different rifle calibers, say .22–.25, .270–.45 or different shotgun gauges, which rods are so formed that they may be jointed so as to provide field rods of sufficient working lengths as may be required.

The handle being interchangeable allows fitting to the rods for the cleaning of pistols and rifles, either with one piece rods or jointed rods, as practical The single handle serving that plurality of different rods is preferably formed of a durable and dense plastic, free of any sharp edges or rough surfaces capable of scratching gun stocks or metallic components, so all important a consideration in the case of gun enthusiasts.

That handle will be of in-line type as contrasted with the familiar T-types of prior art devices, all so as to offer improved storage possibilities not to mention improved means of control when in actual usage.

Still another feature, the so-called encapsulating feature offers greater overall strength in the tool in the respect that the rod extends fully through the handle between the inboard and outboard ends thereof. Rods having end type arrangements in their handles suffer the disadvantage that they cannot compare strengthwise with the devices hereof wherein the handle offers strength to the rod or, considered reversely, the rod offers strength to the handle.

Gun-wipers as they are usually constructed and used consist of a rigid rod provided upon the end which passes within the barrel with a suitable device for holding the wiping material, and as this wiper is passed back and forth within the barrel it is turned as well as possible by the hand; but this forms a very awkward and inconvenient implement for the purpose; and the object of my invention is to provide a means of more thoroughly and effectually cleaning and scouring the inside of a gun-barrel and of oiling the same in a more efficient manner by allowing revolving the wiper as it is drawn back and forth within the barrel.

Figure 1:
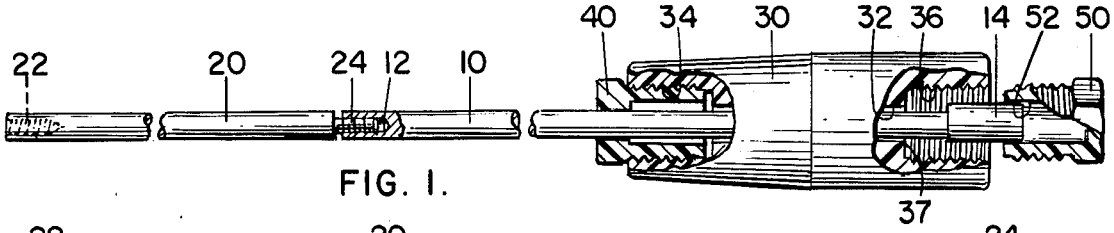
FIG. 1 is a broken view in side elevation of my improved wiper device with parts of the handle being shown in section.
Figure 2:
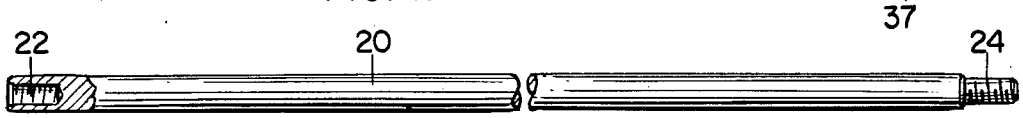
FIG. 2 is an enlarged broken view in side elevation of a section of steel rod which may be jointed to the FIG. 1 rod to provide a longer length rod.
Figure 3:
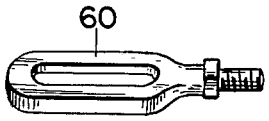
FIGS. 3 and 4 are perspective views of a wiper piece and a brush respectively for threaded engagement with the inboard end of the rod of FIGS. 1 or 2.
Figure 4:
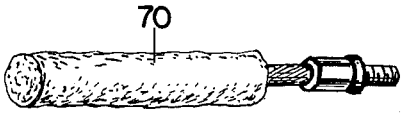

10 represents a cylindrical steel rod which may be provided with internal threads 12 at its inboard end and a cylindrical end cap 14 fixed at its outboard end.

20 represents a second steel rod which may be threadedly engaged to rod 10 by virtue of the external threading 24 at its outboard end, it being provided with internal threads 22 at its opposite inboard end for the reception of a third steel rod if still added length is desideratum.

A handle 30 may be of any suitable size and shape and be provided with a longitudinal cylindrical through bore 32 centrally thereof with an enlarged bore or axial longitudinal pocket or recess 34 communicating therewith at the inboard end and an enlarged bore 36 at the outboard end, also communicating with through bore 32. Both bores 34 and 36 are threaded as shown.

Enlarged bore 36 allows the reception therein and therethrough of rod 10 until end cap 14 abuts the shoulder 37 defined by enlarged bore 36.

So extended therethrough, a threaded inner cap 40 having a through opening centrally thereof is then sleeved upon the rod at its inboard end and is brought into threaded interengagement with the threads of enlarged bore 34 so as to allow the threading of the cap into snug interrelationship with handle 30.

Therefollowing a threaded outer cap 50 having a central recess 52 therein is brought into interrelationship with end cap 14, the end cap being receivable in the central recess so that the outer cap may be threadedly interengaged with the handle.

If desired, a threaded wiper piece 60 may be secured to the inboard end of the rod 10, if only a single rod is desired for use, or rod 20, if a pair of interrelated rods are desired, provided with a slot for holding a rag, tow or other suitable material for wiping or oiling a gun barrel.

Alternatively, if desired, another threaded wiper piece in the form of a brush 70 may be secured to the inboard end of the rod 10, or the rod 20 as the case may be for the wiping or oiling function.

Operationally, a wiper is placed in the wiper holder and the device is passed into a gun barrel or tube to be reciprocated forwardly and rearwardly to cause the wiper or brush to pass evenly over every portion of the inner surface of the barrel and completely clean or lubricate the same.

Figure 5:
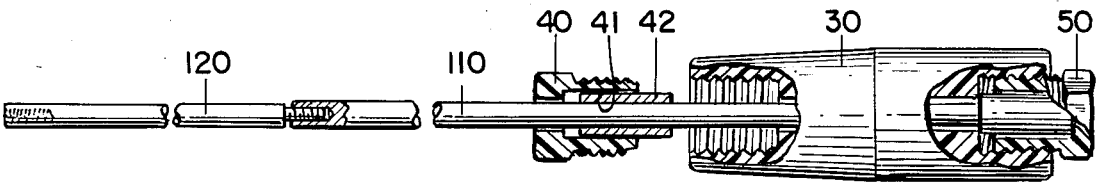
FIG. 5 is a broken view in side elevation with the FIG. 1 handle being shown partly in section.
Figure 6:
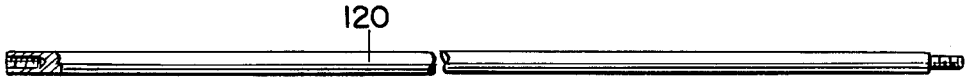
FIG. 6 is a view in side elevation which may be jointed to the FIG. 5 rod to provide a device of longer length.
Figure 7:
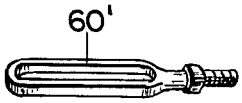
FIGS. 7 and 8 are perspective views of a wiper piece and a brush respectively for threaded engagement with the inboard end of the rod of FIGS. 5 or 6.
Figure 8:
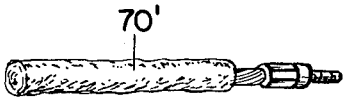

As has been explained earlier, an alternative apparatus may be built as shown in FIGS. 5–8 employing the identical handle 30 but involving rods 110 and 120 of different diameters.

In this instance, the threaded inner cap 40 is provided with a bushing 42 which is sleeved upon rod 110 and is nestably receivable in the enlarged bore 41 of inner end cap 50 so as to insure a snug bearing interrelationship between handle and rod when the end cap is walked into threaded engagement with the handle with the rod being unencumbered and freely rotatable when in use. That is the handle allows spiralling in the rod as it is reciprocated through the barrel.

Threaded wiper piece 60' (FIG. 7) and threaded brush 70' (FIG. 8) will be of different dimensions so as to accommodate to and be threadedly engageable with the threaded ends of the rods 110 or 120 as appropriate.

I claim:

1. A system of interchangeable gun bore cleaning implements for ready field disassembly and reassembly comprising:

a plurality of rods having differing sizes according to rod diameters for use in the cleaning of guns having calibers accommodated by respective rods of complemental sizes, each rod having an inboard and an outboard end, a common handle accommodating to each of the rods, the handle having inboard and outboard ends and a central longitudinally-extending through-bore therethrough communicating with and in-line with a central enlarged threaded inwardly-extending recess at each of the inboard and outboard ends, each rod having an enlarged end head fixed at its outboard end and said head being of a diameter for snug nesting in the enlarged recess at the handle outboard end with the end head seating on the bottom wall of the recess as the rod is extendible inwardly through the outboard recess and throughbore and outwardly through the inboard recess, an outboard end cap configured by a transverse end wall and a cylindrical wall projecting therefrom with threading on the exterior surface of the cylindrical wall and an open-ended well interiorly of the cylindrical wall for receiving the enlarged end head of the rod and for threaded engagement with the outboard recess of the handle for encapsulating the end cap relative to the handle, an inboard end cap configured by a transverse end wall having a central through opening therethrough and a cylindrical wall projecting therefrom with threading on the exterior surface of the cylindrical wall and an open-ended well interiorly of the cylindrical wall, the inboard end cap being sleevable along the rod from its inboard end and for threaded engagement with the inboard recess of the handle.

the rod and handle being freely rotatable as to each other, a bushing selectively receivable in the wall of the inboard end cap for accommodating rods of smaller diameters in insuring a snug interengagement.

* * * * *